United States Patent [19]

Hinz et al.

[11] Patent Number: 4,665,869

[45] Date of Patent: May 19, 1987

[54] VALVE SPRING RETAINER AND PROCESS FOR ITS PRODUCTION

[75] Inventors: Bernhard Hinz, Frankfurt; Walter Steigleder, Stuttgart, both of Fed. Rep. of Germany

[73] Assignee: Deutsch Forschungs- und Versuchsanstalt fur Luft- und Raumfahrt e.V., Bonn, Fed. Rep. of Germany

[21] Appl. No.: 782,438

[22] Filed: Oct. 1, 1985

[30] Foreign Application Priority Data

Oct. 3, 1984 [DE] Fed. Rep. of Germany ..... 3436193

[51] Int. Cl.[4] ..... F01L 3/10

[52] U.S. Cl. ..... 123/90.67; 123/188 SB; 251/337

[58] Field of Search ..... 123/90.67, 188 SB, 188 SC, 123/188 AF, 188 SA; 251/337

[56] References Cited

U.S. PATENT DOCUMENTS 3,021,593 2/1962 Cousino ..... 123/90.67
3,043,284 7/1962 Gundstrom ..... 123/90.67
3,265,053 8/1966 Fitzsimons ..... 123/90.67
4,432,311 2/1984 Holtzberg et al. ..... 123/90.67

FOREIGN PATENT DOCUMENTS 224410 12/1984 Japan ..... 123/188 SB

*Primary Examiner*—Ira S. Lazarus
*Attorney, Agent, or Firm*—Kenway & Jenney

[57] ABSTRACT

In order to adjust the fiber orientation of a valve spring retainer made of carbon fiber reinforced synthetic material to the stresses appearing in practical operation, it is suggested that several stacked carbon fiber tissue layers be bedded into the valve spring retainer, that a conical opening run vertical to the tissue layers through these, that the weft and warp threads of the tissue layers are displaced from the cross section of the opening to the outside and each project over a part of the perimeter of the opening and that in the edge area of the opening the displaced weft and warp threads have a greater thickness than in the areas farther away from the opening. Furthermore, a process for the production of such a valve spring retainer is discussed.

5 Claims, 4 Drawing Figures

VALVE SPRING RETAINER AND PROCESS FOR ITS PRODUCTION

The invention concerns a valve spring retainer made of carbon fiber-reinforced synthetic material as well as a process for the production of such a valve spring retainer.

Valve spring retainers are used in combustion motors in order to transfer the force of a coil spring enclosing a valve stem to the valve stem. The coil spring is supported by the spring retainer, which is attached to the valve stem with two clamping cone halves. This attachment causes a complex development of forces in the valve spring retainer. Due to the low wedge angle of the conical opening in the valve spring retainer which receives the clamping cone halves, the spring force that is introduced brings with it a large radial force. This also causes high external stresses in the core of the valve spring retainer, aside from axially operating tensile stresses.

The transition area from the core to the contact surface of the valve spring is subject to bending and shearing stresses.

Customarily valve spring retainers are made from case hardened steel due to these stresses.

It would be desirable to replace this material by lighter materials in order to keep the forces of gravity of the control drive as low as possible. It has already been known to make valve spring retainers from composite fiber materials (Dr. D. Lutz "Oriented carbon short fibers in automobile production", Lecture for the coordination district conference "Composite fiber materials" 1983; "Plastic Engine is Off and Running," Mach. Des. 52 (1980) 10). The known valve spring retainers are made of short fiber-reinforced synthetic materials, and these have shown only low solidity and rigidity as a result, so that these valve spring retainers experience great elastic and plastic deformations.

It is the task of the invention to produce a valve spring retainer of the same type with improved rigidity and solidity.

This task is solved according to the invention for a valve spring retainer of the above described type in such a way that several carbon fiber tissue layers lying on top of one another are bedded into the valve spring retainer, that a conical opening runs vertically through these to the tissue layers, that the weft and warp threads of the tissue inlays are pushed from the cross-section of the opening to the outside and project over a part of the perimeter of the opening and that in the edge area of the opening the displaced weft and warp threads form a greater thickness of tissue layers than in the areas farther from the opening.

The use of tissue layers with weft and warp threads crossing each other and the displacement of the threads in the area of the opening going through the tissue layer make possible a particularly favorable fiber arrangement in the synthetic material, which is always adjusted to the stresses that may appear in various areas of the valve spring retainer. The fibers run along the opening essentially in the perimeter direction and thus take on the elongation stress along the opening perimeter, but on the outer edge the fibers run approximately radially.

It is particularly favorable if the tissue layers bulge out in the area of the opening at their ends with a smaller diameter. In this way the tissue layers do not run parallel to the front surface of the valve spring retainer in the ring area enclosing the opening, but diagonally to it, so that a particularly good rigidity can be obtained in the outer area that is subject to bending stress.

It is also favorable if the bulge extends to the edge area of the valve spring retainer, that is if the tissue layers run sloping to the front surface even in the boundary area.

It is particularly favorable if the bulge of the tissue layers increases toward the end of the opening with a smaller diameter. This is achieved in a simple way in that the tissue layers are thicker in the immediate environs of the opening than in the areas farther from the opening, so that the distance of the individual tissue layers is greater in the area of the opening than in the vicinity of the outer edge.

It is favorable if tissue layers lying on top of one another are twisted contrary to each other in such a way that the threads of tissue layers lying on top of one another do not run parallel to one another. For example, tissues on top of one another can be twisted by 45°, but it is also posssible to provide for lesser twist angles from tissue layer to tissue layer. In this way, the valve spring retainer can be made largely rotation-symmetric in regard to its solidity properties.

It is furthermore the task of the invention to indicate a process for the making of such a valve spring retainer.

This task is solved with a process of the kind described above according to the invention in such a way that several tissue layers made of carbon fibers are pressed onto a conical mandrel so far that the mandrel penetrates through the tissue layers, that the tissue layers saturated in hardenable synthetic material are pressed together and that the synthetic is allowed to harden in this way.

The pressing of the tissue layers onto a conical mandrel divides in a simple way the weft and warp threads in the tisue as desired, that is these threads are pushed to the side by the mandrel and are laid down at the perimeter of the mandrel, so that they run along a perimeter section in the area of immediate vicinity to the opening formed by the mandrel. This deformation is also continued a little further from the opening and increasingly loses itself in the areas farther out.

It is possible here to press tissue layers that have been preimpregnated with hardenable synthetic material onto the mandrel, but one can also apply the hardenable synthetic to the tissue layers after these have been pressed onto the mandrel.

The tissue layers can be individually pressed onto the mandrel; another process calls for pressing several tissue layers lying on top of one another onto the mandrel simultaneously.

During this pressing the stacked tissue layers bulge more in the perimeter area of the opening due to the greater tissue thickness, so that a bulge increasing in the direction of the tip of the mandrel of the individual tissue layers appears.

It is of advantage if one uses a mandrel whose conicity corresponds to that of the clamping cone halves with whose aid the valve spring retainer is attached to a valve stem. It is therefore no longer necessary to re-finish the inner opening.

This process can be especially advantageously carried out if one sets a mold over the mandrel after applying the tissue layers onto the mandrel which presses the tissue layers together to a desired volume, and if one undertakes the hardening of the synthetic material when the mold is set on. By using such a mold the tissue layers are definedly pressed together and take up a precisely pre-determined and desired volume, so that valve spring retainers with reproducible properties can be produced.

After the hardening the valve spring retainers can be mechanically finished on the outer surfaces so that they receive the desired outer contour.

The following description of preferred design models of the invention serves for a detailed explanation in connection with the figures.

Figure 3:
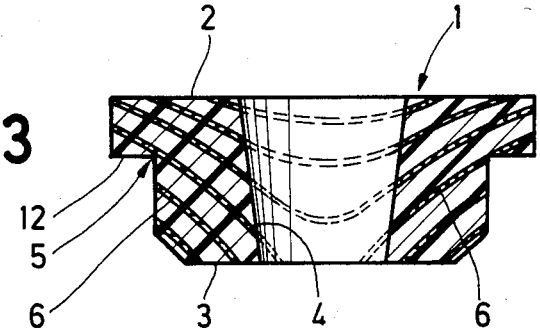
FIG. 3 shows a cross section of a valve spring retainer according to the invention.

FIG. 3 shows a sectional view of a valve spring retainer 1, which has an upper level front side 2 and a lower front side 3 running parallel to it. An opening 4 which gets narrower conically from top to bottom runs through the valve spring retainer from the upper front side to the lower front side. The lower part of the valve spring retainer 1 has a smaller diameter than the upper part, so that there is a step 5 in the transition area.

The valve spring retainer 1 is slanted at the lower edge.

Figure 1:
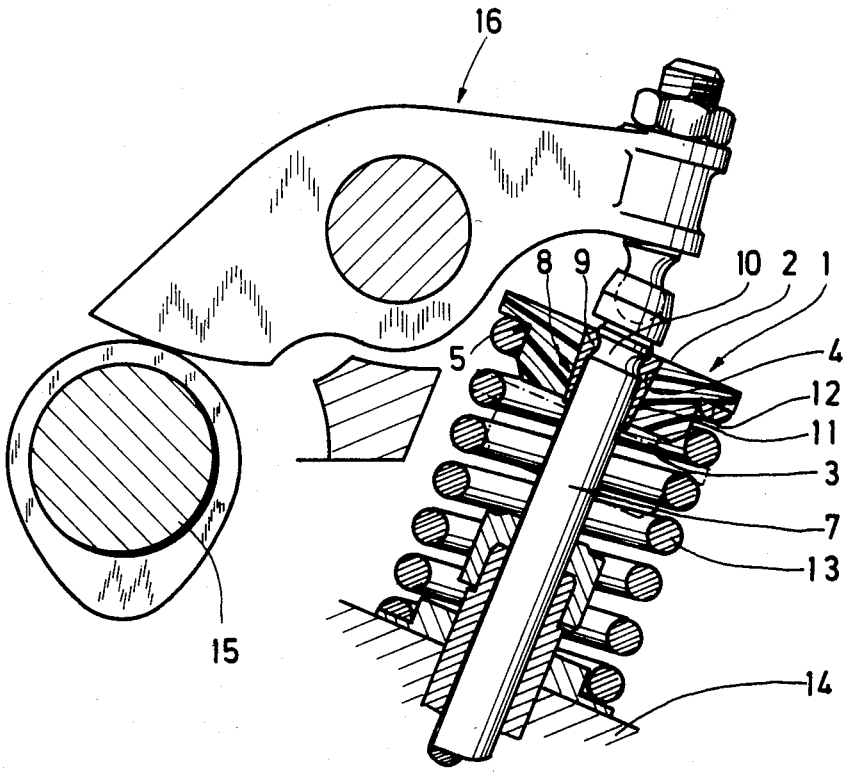
FIG. 1 shows a schematic view of a valve set in a combustion engine with a valve spring retainer according to the invention.

Such a valve spring retainer with a shape that is actually already known can be attached to a valve stem 7 in a way which can be seen in FIG. 1. Tow clamping cone halves 8 are used for this purpose which enclose the valve stem 7 and dip into a corresponding ring 10 of the valve stem. The clamping cone halves 8 have an outer shell 11, whose conicity agrees with that of the opening 4.

The valve spring retainer 1 is pushed over the two clamping cone halves 8 and thu presses the two clamping cone halves tightly against the valve stem 7. At the same time the valve spring retainer 1 is secured thereby against a further shifting in the longitudinal direction of the valve stem.

The shoulder 12 at the lower side of the upper valve spring ring part formed by the step 5 forms a contact surface for a coil spring 13 enclosing the valve stem 7, which is supported by the engine casing 14 and makes impact on the valve stem 7 with an elastic force directed to the outside over the valve spring retainer.

By means of a cam lever 16 driven by a camshaft 15 which rests spherically against the valve stem 7, the valve stem can be shifted to the inside against the force of the coil spring 13, whereby the valve spring retainer takes over the task of guiding the force of the coil spring into the valve stem.

Figure 4:
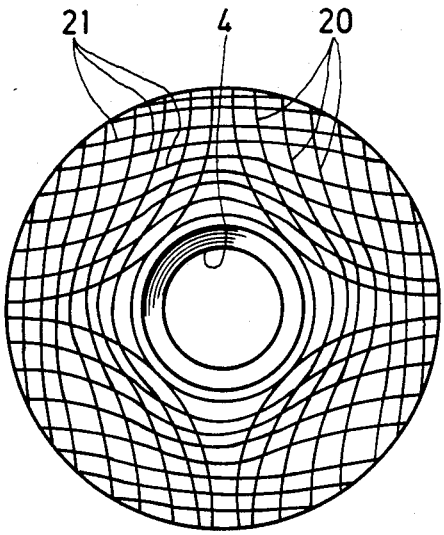
FIG. 4 shows a top view of the fiber orientation in a tissue layer in the inside of the valve spring retainer according to the invention.

The valve spring reatiner according to the invention is made of a greater number of carbon tissue layers 6 and a hardenable resin in the following way:

On a conical mandrel 17, whose conicity and thickness correspond to the conicity or rather the diameter of the opening 4 in the valve spring retainer and which is enclosed by a level contact surface 18, a greater number of carbon tissue layers 6 are pressed on one after the other or simultaneously in such a way that the slanted tip 19 of the mandrel 17 penetrates through the tissue layers. The tissue layers are shifted along the mandrel in the direction of the level contact surface 18, whereby the weft and warp threads 20 and 21 are displaced sideways by the mandrel from the area of the opening made by the mandrel, whereby the threads lie against the perimeter of the opening in the area close to the opening and run over a certain angle along this perimeter, as is shown in FIG. 4. The displacement of the threads is continued even in attenuated form until an area farther from the opening, whereby only small disturbances of the initial fiber orientation of the inner tissues can be observed in the outlying areas. There is thus in sum an essentially ring-shaped pattern in the tissue layers in the area of the opening in this way, but in more outlying areas the weft and warp threads cross each other in the manner of an undisturbed tissue.

Through the displacement of the fibers they become thicker in the perimeter area, so that the thickness of the tissue layers is larger in the immediate perimeter area of the opening than in outlying areas.

Figure 2:
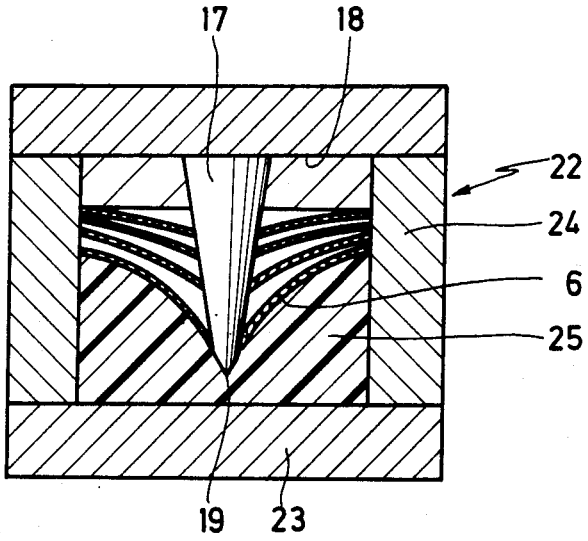
FIG. 2 shows a sectional view of a mandrel and a mold for producing the valve spring retainer according to the invention.

The tissue layers pressed onto the mandrel in this way either individually or as a package of several tissue layers bulge in the direction of the mandrel tip due to the greater thickness of the tissue layer in the area close to the mandrel, whereby this bulging increases gradually in the direction of the mandrel tip. This bulge has the result that the tissue layers opposite the upper front side 2 run in an inclined manner, whereby the inclination increases in the direction of the mandrel and the mandrel tip (FIG. 2).

The tissue layers can also be impregnated with a hardenable synthetic material when they are pressed onto the mandrel, but it is also posssible to apply a hardenable synthetic material onto the tissue layers only when they are pressed onto the mandrel.

If the tissue layer provided with a hardenable synthetic material are pressed onto the mandrel, a mold 22 is set on the mandrel. This mold 22 has a wall 23 opposite the contact surface 18 as well as side walls 24 closing off sideways with the contact surface 18 and the wall 23, whereby a formed piece 25 is inserted on the interior of the mold 22, which leaves free a spherical area with a V shape in cross section between it and the contact surface when the mold is put on in which the tissue layers and the hardenable synthetic resin are found.

When the mold is put on the mandrel, the tissue layers are pressed together by the formed piece 25 and is pushed further onto the mandrel if necessary, whereby excess synthetic resin can come forth sideways from the mold. This guarantees that the tissue layers are always compressed in the same way and that the proportion of synthetic resin to the total material of the valve spring retainer always remains the same; for example the fiber volume percent can be 65% if one uses known resin systems, such as a mixture of triglycidylisocyanurate (TGIC) and methylnadic acid anydrid (MNSA).

When the mold is completely closed, the hardening process begins through a heat treatment. The formed piece 25 can consist of a material which has a strong expansion when heated, so that the shrinking present in hardening can be equalized by the formed piece. For instance, the formed piece can consist of thermal expansion rubber (TER), which is a special silicon rubber with especially high heat expansion After hardening the raw product obtained this way is mechanically processed externally, for instance through rotating or grinding, until the desired outer contour is achieved. The opening 4 formed by the mandrel however required no further finishing, if the dimensions of the mandrel and the dimensions of the clamping cone halves are equal.

We claim:

1. Valve spring retainer made of carbon fiber reinforced synthetic material, characterized by the fact that several stacked carbon fiber tissue layers (6) are bedded into the valve spring retainer (1), that a conical opening (4) run vertical to the tissue layers (6) through these, that the weft and warp threads (21, 20) of the tissue layers (6) are displaced from the cross section of the opening (4) to the outside and each project over a part of the perimeter of the opening (4) and that in the edge area of the opening (4) the displaced weft and warp threads (21, 20) have a greater thickness of the tissue layers (6) than in the areas farther away from the opening (4).

2. Valve spring retainer according to claim 1, characterized by the fact that the tissue layers (6) in the area of the opening (4) bulge in the direction of their end with a smaller diameter.

3. Valve spring retainer according to claim 2, characterized by the fact that the bulge extends to the edge area of the valve spring retainer (1).

4. Valve spring retainer according to claim 1, characterized by the fact that the bulge of the tissue layers (6) increases with a smaller diameter in the direction of the end of the opening (4).

5. Valve spring retainer according to claim 1, characterized by the fact that tissue layers lying on top of one another (6) are twisted in such a way against each other that the threads (20, 21) of stacked tissue layers (6) do not run parallel.

* * * * *